US005829740A

United States Patent [19]

Kerpe et al.

[11] Patent Number: 5,829,740

[45] Date of Patent: Nov. 3, 1998

[54] DEVICE FOR THE TEMPORARY GUIDANCE OF SUCCESSIVELY TRANSPORTED SHEETS

[75] Inventors: Sven Kerpe, Bruchsal; Frank Gunschera, Nussloch, both of Germany

[73] Assignee: Heidelberger Druckmaschinen AG, Heidelberg, Germany

[21] Appl. No.: 740,252

[22] Filed: Oct. 25, 1996

[30] Foreign Application Priority Data

Oct. 25, 1995 [DE] Germany ..... 195 39 663.4

[51] Int. Cl.[6] ..... B65H 5/02

[52] U.S. Cl. ..... 271/276; 271/197

[58] Field of Search ..... 271/183, 196, 271/197, 276, 188, 209

[56] References Cited

U.S. PATENT DOCUMENTS

| | | | |
|---|---|---|---|
| 1,627,966 | 5/1927 | Goodlett | 271/196 X |
| 3,889,801 | 6/1975 | Boyer | 271/197 X |
| 3,942,788 | 3/1976 | Boyle . | |
| 4,555,013 | 11/1985 | Franklin | 271/197 X |

FOREIGN PATENT DOCUMENTS

| | | |
|---|---|---|
| 11 19 167 | 12/1961 | Germany . |
| 25 23 430 | 12/1976 | Germany . |
| 40 17 931 | 1/1991 | Germany . |

*Primary Examiner*—David H. Bollinger
*Attorney, Agent, or Firm*—Herbert L. Lerner; Laurence A. Greenberg

[57] ABSTRACT

A device for the temporary guidance of successively transported sheets along a guiding surface defined by opposite side edges of a sheet, includes a sheet guiding element revolving in a given direction during operation. The guiding element has a groove oriented at least substantially in the given direction and the guiding element has at least one suction opening formed therein. The at least one suction opening has an aperture cross section in the groove to be temporarily covered by a sheet, and the at least one suction opening is subjected to a periodic underpressure exerting a suction effect on a sheet. Such a device exhibits good guiding characteristics at high sheet speeds.

3 Claims, 2 Drawing Sheets

DEVICE FOR THE TEMPORARY GUIDANCE OF SUCCESSIVELY TRANSPORTED SHEETS

BACKGROUND OF THE INVENTION

1. Field of the Invention

The invention relates to a device for the temporary guidance of successively transported sheets along a guiding surface defined by opposite side edges of a respective one of the sheets, including a guiding element revolving during operation for guiding the sheet, the guiding element having at least one suction opening with an aperture cross section to be temporarily covered by a respective sheet, and a periodically existing underpressure in the at least one suction opening exerting a suction effect on a respective one of the sheets.

Such a device which is known, for example, from German Published, Non-Prosecuted Patent Application DE 40 17 931 Al is used in order to slow down sheets released from a chain delivery system of a printing press from machine speed to a lower speed.

In that known device the rotating guiding element is constructed as a suction belt provided with holes and is driven through a special kind of form-locking connection between the belt and a drive wheel. It was the aim of that form-locking connection, among others, to counteract the disadvantageous consequences of wear and tear of the guiding element in the case of a force-locking drive of the guiding element. A force-locking connection is one which connects two elements together by force external to the elements, as opposed to a form-locking connection which is provided by the shapes of the elements themselves.

Tests carried out by the applicants with a device as described above, wherein the guiding element thereof had been made more resistant to wear and tear by using suitable materials, resulted in unsatisfactory guiding characteristics of the guiding element, particularly when operated at high rotational speeds and with thin sheets.

2. Summary of the Invention

It is accordingly an object of the invention to provide a device for the temporary guidance of successively transported sheets, which overcomes the hereinafore-mentioned disadvantages of the heretofore-known devices of this general type and which ensures good guiding characteristics of a guiding element, even at high rotational speeds and with thin sheets, regardless of the kind of material of which the guiding element is made.

With the foregoing and other objects in view there is provided, in accordance with the invention, a device for the temporary guidance of successively transported sheets along a guiding surface defined by opposite side edges of a sheet, comprising a sheet guiding element revolving in a given direction during operation, the guiding element having a groove oriented at least substantially in the given direction and the guiding element having at least one suction opening formed therein, the at least one suction opening having an aperture cross section in the groove to be temporarily covered by a sheet, and the at least one suction opening being subjected to a periodic underpressure exerting a suction effect on a sheet.

With this embodiment, upon the guidance of thin sheets, a crease is formed in the sheet in the region of the groove, whereby the sheet is drawn or creased into the groove, so that the sheet is guided by the crease along the guiding surface without lateral shifting, in spite of disturbing influences acting on the sheet.

For example, disturbing influences can be differences in pressure occurring in the region of the guiding element between one surface and another surface of the sheets, due to a high rotational speed of the guiding element, and in the case of the use of the device as a sheet brake being disposed at the end of a chain delivery system of a printing press, the disturbing influences can be masses of air that the gripper devices of the chain delivery system push ahead of themselves, so that the air masses act on the respective sheets released by the gripper devices causing a curling-up of the trailing edge of the sheet.

A device which is constructed in accordance with the present invention also has an advantageous effect on the guiding characteristics of the guiding element in the case of the guidance of thicker sheets. The reason for this is an enlarged surface region of the sheet with respect to the aperture cross section of the suction opening. The suction effect of the underpressure existing in a suction opening takes place on that enlarged surface.

In accordance with another feature of the invention, the guiding element is constructed in the form of an endless belt of a belt conveyor.

In accordance with a concomitant feature of the invention, the guiding element is constructed in the form of a rotor which rotates around an axis of rotation during operation, the rotor has an outer cylindrical or jacket surface being concentric with the axis of rotation, and the at least one suction opening penetrates the outer cylindrical surface and together with further respective suction openings forms at least one row of suction openings extending about the circumference of the rotor.

Other features which are considered as characteristic for the invention are set forth in the appended claims.

Although the invention is illustrated and described herein as embodied in a device for the temporary guidance of successively transported sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
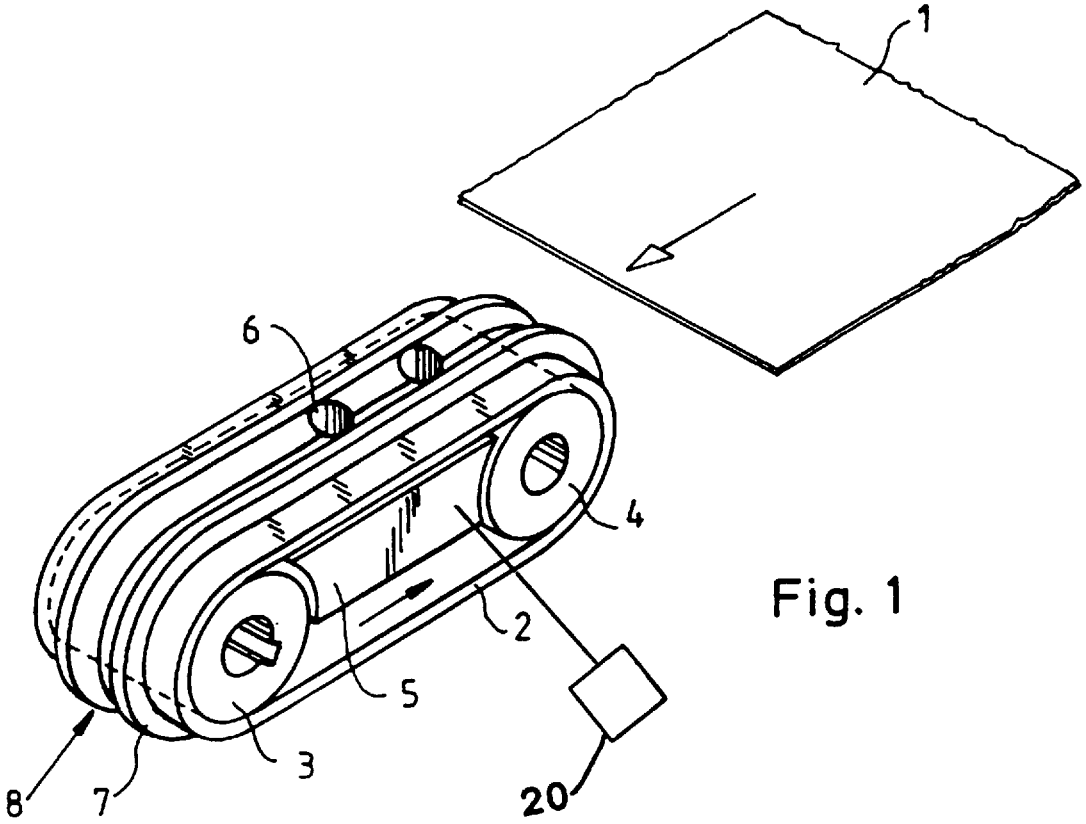
FIG. 1 is a fragmentary, diagrammatic, perspective view of a first exemplary embodiment of the invention with a first variant of a guiding element formed as an endless belt and with a sheet being moved in the direction of the guiding element.

Referring now to the figures of the drawings in detail and first, particularly, to FIG. 1 thereof, there is seen an exemplary embodiment in which temporary guidance of successive sheets 1 takes place while a lower surface of a sheet 1 is in contact with a guiding element 2 formed as a rotating endless belt of a belt conveyor. The belt-type guiding element 2 winds around a first guide roller 3 which is connected with a non-illustrated drive shaft of a rotary drive as to be fixed against rotation. The guiding element 2 also winds around a freely rotatable second guide roller 4 located in axially parallel relation to the first guide roller 3. The guiding element 2 rotates in the direction of an arrow indicated at a lower part of the guiding element 2 in FIG. 1. A suction chamber 5 which is disposed below an upper part or strand of the guiding element 2 is connected with a underpressure, negative pressure or vacuum source 20. An underpressure can be created in the region of an inner surface of the upper part of the guiding element 2 through the use of the suction chamber 5. In the present example the guiding element 2 is penetrated by suction openings 6 which are distributed over its length essentially in direct succession, so that an underpressure is created in a respective partial amount of the suction openings 6 while the partial amount of suction openings 6 passes over the suction chamber 5 during operation. In FIG. 1 only two of the suction openings 6 distributed over the length of the guiding element 2 are illustrated.

An outer surface of the belt-type guiding element 2 further includes a rib 7 extending over the entire length thereof and being penetrated by the suction openings 6. An outer surface of the rib 7 facing away from the inner surface of the guiding element 2 is provided with a groove 8 oriented in the direction of rotation of the guiding element 2. Aperture cross sections of the suction openings 6 facing the outer surface of the rib are situated in the groove 8.

Devices for feeding the sheets 1 to the guiding element 2 and for their positioning immediately above the guiding element 2 are not directly part of the subject of the present invention. The positioning takes place in such a way that side edges of the sheets 1 are oriented in the direction of rotation of the guiding element 2.

A possible field of application of the device according to the present invention is, for example, its use as a sheet brake between a chain delivery system and a delivery pile of a sheet-fed printing press. In this embodiment the chain delivery system first guides a respective sheet 1, in accordance with the direction of an arrow indicated at the sheet 1 shown in FIG. 1, into a position located directly above the guiding element 2 and then releases the sheet 1 in such a manner that, particularly in a trailing region of a respective sheet 1, there is contact between the lower surface of the sheet and the guiding element 2, due to the suction effect of the underpressure existing in the suction openings 6. The contact is achieved by temporarily covering the aperture cross sections or mouth profiles of the suction openings 6 and as a result of the revolution of the guiding element, the suction openings 6 preceding each other counter to the direction of revolution successively face the lower surface of the sheet.

Figure 4:
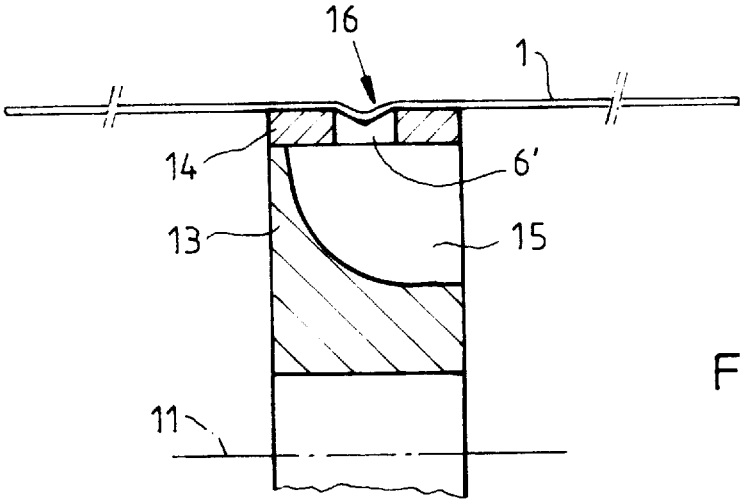
FIG. 4 is a fragmentary, axial cross-sectional view of the rotor according to FIG. 3 and a cross-sectional view of a sheet guided by the rotor, with lateral edges of the sheet being oriented perpendicular with respect to the drawing plane.

Upon the guidance of sheets 1 of thin paper, the configuration of the aperture cross sections of the suction openings 6 in the groove 8 has the effect of forming a crease or draw 16 in the respective sheet 1 in conformity with the profile of the groove 8, as is seen in FIG. 4. This crease 16 has a favorable influence on the guiding characteristics of the device in multiple ways.

First of all, with sheets of thin paper, this crease 16 has a stabilizing effect on the position of the sheet 1 in transverse direction with respect to the direction of rotation of the guiding element 2, thus counteracting a shifting in the transverse direction. Furthermore, as a result there is a tendency with sheets 1 of thin paper toward the suction effect exerted on the sheet 1 through the underpressure existing in the suction openings 6 being increased when a compressive force acts on the lower surface of the sheet, due to differences in static pressure in the vicinity of the sheet 1.

The tendencies toward an increase of the suction effect and thereby the holding force with which the sheet 1 is pressed onto the guiding element 2 under this suction effect are based on the fact that a release of a region of the sheet 1 from this crease 16 would result in an enlargement of the region of the lower surface of the sheet that was subjected to the underpressure in the suction openings 6 and would consequently result in an increase of the holding force.

According to a further manner of using the device as a sheet brake, an additional favorable influence on the guiding characteristics of the guiding element 2 is provided by the fact that the crease 16 counteracts curling-up of the trailing edge of the sheet 1 which is subjected to the effect of air flow fields that are created, for example, by rotating gripper devices of a chain delivery system. The causes counteracting the curling are found on one hand in the already mentioned tendency toward an increase of the holding force in the case of increased static pressure on the lower surface of the sheet, and on the other hand in the stiffening effect of the crease 16 in the sheet which impedes bending around a bending edge extending transversely with respect to the groove 8.

Figure 2:
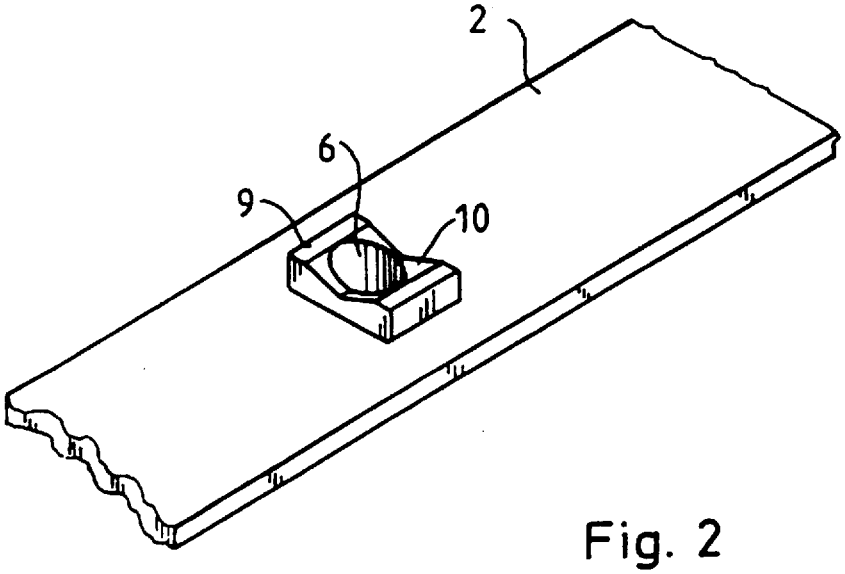
FIG. 2 is a fragmentary, perspective view of a section of a second variant of the guiding element formed as an endless belt.

The exemplary embodiment illustrated in FIG. 1 can be modified into a second variant, particularly by providing a guiding element 2' which is partially shown in FIG. 2 and corresponds with the guiding element 2 of FIG. 1 to the extent that it is also constructed as an endless rotating belt of a belt conveyor but differs from the guiding element 2 of FIG. 1 in that only a single suction opening 6 is provided.

A variant of such a construction can also be used as a sheet brake in the above-described relationship. Therefore, it enables in particular the exclusive gripping of a region of the lower surface of the sheet 1 close to the trailing edge of the sheet 1 through the use of the guiding element 2' during the rotation of the guiding element corresponding to a cycle of conveyance of the successive sheets in a suitable phase position to the chain delivery system.

In the illustrated exemplary embodiment, the single suction opening 6 is placed within a cam 9 which is provided on the guiding element 2' that is constructed as a belt of a belt conveyer. The cam 9 projects from the outer contour of the otherwise flat belt. This cam 9, in the present exemplary embodiment, has a cross section corresponding to the rib 7 of FIG. 1 and thus has a notch 10 corresponding to the groove 8 of FIG. 1. In this case, the notch 10 causes the formation of a crease 16 in the sheet 1 when the latter is subjected to the underpressure existing in the suction opening 6.

The groove 8 and the notch 10, in the exemplary embodiments according to FIGS. 1 and 2, are worked into the rib 7 and into the cam 9 in the form of a prism. This form, however, is not mandatory. The cross sections of the groove 8 and the cam 9 can also have a rounded or rectangular profile, for example.

The guiding element 2' which is partially illustrated in FIG. 2 may be constructed with a plurality of cams 9 having respective suction openings 6 placed therein. In this embodiment the rotational speed of the guiding element 2' which is constructed as a belt is selected in such a way that a respective one of the successive sheets 1 is gripped with a respective one of the successive cams 9.

Figure 3:
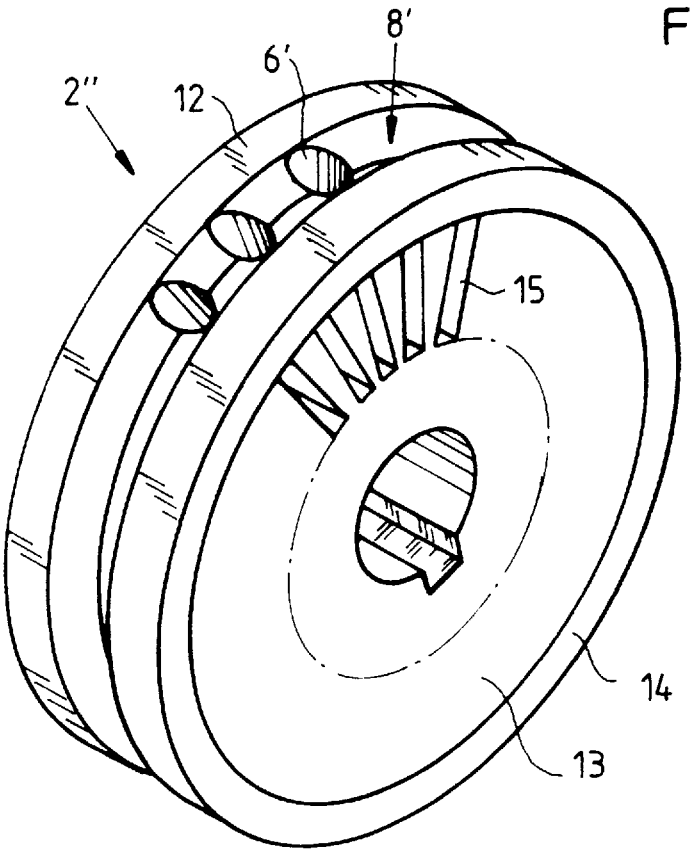
FIG. 3 is a perspective view of a second exemplary embodiment of the guiding element in the form of a rotor.

In a second exemplary embodiment, a guiding element 2" shown in FIGS. 3 and 4 is constructed as a rotor which rotates during operation around an axis of rotation 11 and has an outer cylindrical surface 12 which is concentric with the axis of rotation 11. This outer cylindrical surface 12 is penetrated by suction openings 6' disposed essentially directly one after the other along a circumferential line. The suction openings 6', in their entirety, form a row of suction openings extending over the circumference of the rotor.

In the present exemplary embodiment the guiding element 2" which is constructed as a rotor is formed of a disk 13 and a ring 14 fitted on the periphery of the disk 13. The ring 14 is penetrated by the suction openings 6' and is preferably made of material that is resistant to wear and tear. The disk 13 has open slits 15 which are worked into the disk 13 so as to be distributed over the circumference of the disk 13 in a radial outer diameter-region and oriented radially outwardly and towards one side surface of the disk 13. Each of the slits 15 communicates with a respective suction opening 6'.

In order to guide the sheets 1 in an upper region of the outer cylindrical surface 12 of the guiding element 2" of such a construction, a non-illustrated suction chamber engages one side surface of the disk 13 that is interrupted by the slits 15, i.e. in an upper section thereof including a radial extension of the slits 15. The suction chamber is connected to an underpressure source. In order to achieve the rotation of the guiding element 2" of such a construction, the disk 13 is connected with a drive shaft of a non-illustrated rotary drive in such a way as to be fixed against rotation.

The suction openings 6' open out in a radially outward direction in a groove 8' formed in the ring 14 and are distributed over the circumference thereof. When a sheet 1 of thin paper is guided in the upper region of the outer cylindrical surface 12 of the guiding element 2" during operational rotation of the guiding element 2", the above-described crease 16 is formed in the sheet 1 in a contact region between the outer cylindrical surface 12 and the sheet 1.

Depending on the respective dimensions of the guiding elements 2 or 2' or 2" according to the illustrated exemplary embodiments, multiple suction openings 6, 6' or rows of suction openings that are spaced apart from each other in a direction transverse to the direction of rotation may open into a respective number of grooves 8, 8' or notches 10.

A strict orientation of the grooves 8, 8' or the notches 10 in the direction of rotation of the guiding elements 2, 2', 2" is not mandatory. The grooves 8, 8', for example, may have a slightly sinusoidal arcuate shape and the notches 10 may be disposed obliquely to a certain extent with respect to the direction of rotation.

Preferably, a plurality of devices of the kind described herein is used for the guidance of sheets 1, particularly in dependence on the format of the sheets 1, whereby these devices are disposed at a distance from one another so as to be positioned transversely to the direction of rotation and be equally oriented to the direction of rotation of the respective guiding element 2, 2', 2".

Although the subject of the present invention may preferably be used as a sheet brake, general sheet guidance can also be realized with devices of the kind described herein, and in a particularly advantageous way when secure sheet guidance at high sheet speed without lateral drifting of the sheets is to be ensured.

We claim:

1. In combination with a suction apparatus, a device for the temporary guidance of successively transported sheets along a guiding surface, the device comprising:

a sheet guiding element revolving in a given direction during operation, said guiding element having a groove oriented at least substantially in said given direction and said guiding element having at least one suction opening formed therein, said at least one suction opening having a aperture cross section in said groove to be temporarily covered by a sheet, and the suction apparatus subjecting said at least one suction opening to a periodic underpressure for exerting a suction effect on a sheet.

2. The device according to claim 1, wherein said guiding element is an endless belt of a belt conveyor.

3. The device according to claim 1, wherein said guiding element is a rotor rotating about an axis of rotation during operation, said rotor having a circumference and a cylindrical jacket surface concentric with the axis of rotation, and said at least one suction opening including at least one row of suction openings penetrating said cylindrical jacket surface in substantially direct succession over the circumference of said rotor.

* * * * *